US010618019B2

(12) United States Patent
Grover

(10) Patent No.: US 10,618,019 B2
(45) Date of Patent: Apr. 14, 2020

(54) MIXER TOOL

(71) Applicant: Rick Grover, Haleiwa, HI (US)

(72) Inventor: Rick Grover, Haleiwa, HI (US)

( * ) Notice: Subject to any disclaimer, the term of this patent is extended or adjusted under 35 U.S.C. 154(b) by 0 days.

(21) Appl. No.: 15/482,948

(22) Filed: Apr. 10, 2017

(65) Prior Publication Data

US 2017/0304788 A1 Oct. 26, 2017

Related U.S. Application Data

(60) Provisional application No. 62/326,910, filed on Apr. 25, 2016.

(51) Int. Cl.

| | |
|---|---|
| ***B01F 7/00*** | (2006.01) |
| ***B44D 3/08*** | (2006.01) |
| ***B01F 13/00*** | (2006.01) |

(52) U.S. Cl.

CPC ..... *B01F 7/00566* (2013.01); *B01F 7/001* (2013.01); *B01F 7/0005* (2013.01); *B01F 7/00558* (2013.01); *B01F 13/0028* (2013.01); *B44D 3/08* (2013.01)

(58) Field of Classification Search

CPC .... B01F 7/00566; B01F 7/0005; B01F 7/001; B01F 7/00558; B01F 13/0028; B44D 3/08

See application file for complete search history.

(56) References Cited

U.S. PATENT DOCUMENTS 5,938,325 A * 8/1999 Edwards ..... B01F 7/00066 366/129

* cited by examiner

*Primary Examiner* — Anshu Bhatia

(57) ABSTRACT

An apparatus is disclosed for mixing substances, such as paint. The apparatus includes an elongate member with a plurality of openings formed within it. A filament is threaded through the openings creating bights between openings. The bights and ends of the filament sweep through the substance when the elongate member is rotated, which works to mix the substance.

18 Claims, 6 Drawing Sheets

MIXER TOOL

CROSS-REFERENCE TO RELATED APPLICATIONS

The present application claims the priority under 35 U.S.C. § 119 or the Paris Convention from U.S. Provisional Patent App. No. 62/326,910, filed Apr. 25, 2016, which is hereby incorporated by reference in its entirety.

BACKGROUND

Typical economical mixers, such as paint stirrers, are manually operated. Such mixers require quite a bit of effort to properly mix viscous liquids. And manual mixing typically requires a considerable amount of time. Furthermore, such mixers are often relatively fragile considering the forces and durations needed to mix viscous fluids. Thus, such mixers often do not survive prolonged use and, once broken, are typically discarded.

Thus, there exists a need for a mixer that reduces the effort and time required to mix substances, that is durable, and that may be repaired.

BRIEF SUMMARY

Figure 1:
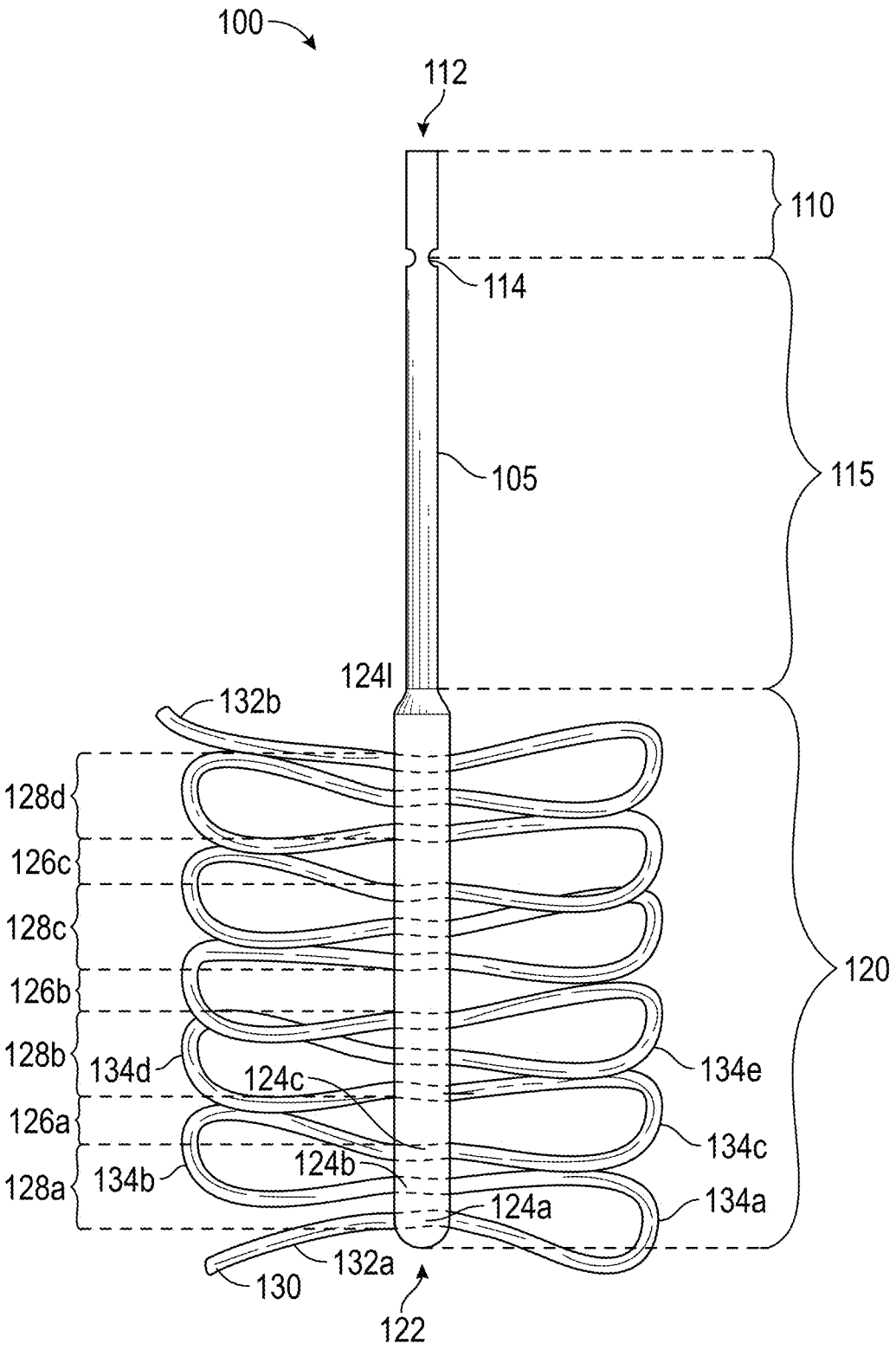
FIG. 1 is a top view of a mixer according to an embodiment.

In an embodiment, an apparatus may include an elongate member having a first end, a second end, a longitudinal axis, and a first section at the first end. The first section may be used to hold the apparatus, e.g., the first section may be held by the chuck of a drill. The first section may have either a circular cross-section or a regular-hexagonal cross-section about the longitudinal axis. The circular cross-section may have a constant diameter for the entirety of the circular cross-section, or the regular-hexagonal cross-section may have a constant long diagonal for the entirety of the regular-hexagonal cross-section. The embodiment further includes one or more openings passing through the elongate member with a filament disposed in each opening and extending from the opening on one or both ends of the opening. In an embodiment, each individual opening has within it an individual filament, the filament extending from one or both ends of the opening so that, when the embodiment is immersed in a substance and rotated, e.g., by a drill, the extended ends of the filament sweep through a volume and may mix the substance. In an embodiment, the filament is continuous and is threaded from one opening to the next creating a bight (or "loop") between adjacent openings. The bight or bights extend from the opening so that, when the embodiment is immersed in a substance and rotated, e.g., by a drill, the bight or bights sweep through a volume and may mix the substance. In an embodiment, a filament is threaded through a subset of the openings, e.g., three openings, which works to retain the filament. In the embodiment, the filament ends extend away from the opening and the bights, between openings, run against or close to the elongate member. In the embodiment, when the embodiment is immersed in a substance and rotated, e.g., by a drill, the ends of the filament extending from the openings may mix the substance. In an embodiment, the filament is flexible such that the apparatus may be inserted through an opening into a volume to mix a substance contained in the volume—the filament flexing toward the elongate member to pass through the opening.

In an embodiment, an apparatus may include an elongate member having a first end, a second end, and a longitudinal axis. Within the elongate member the embodiment may include a plurality of openings with each opening passing through the elongate member and a filament threaded through each of the plurality of openings. In an embodiment, the filament is continuous and is threaded from one opening to the next creating a bight (or "loop") between adjacent openings. In an embodiment, the ends of the filament extend from the openings, while the bights between openings lay against or are close to the elongate member such that, when the embodiment is immersed in a substance and rotated, e.g., by a drill, the extended ends may mix the substance. In an embodiment, the bight or bights extend from the opening so that, when the embodiment is immersed in a substance and rotated, e.g., by a drill, the bight or bights sweep through a volume and may mix the substance. In an embodiment, the elongate member includes a second plurality of openings with a second filament threaded from one opening of the second plurality to the next opening of the second plurality so that, when the embodiment is immersed in a substance and rotated, e.g., by a drill, the bights (if extended), the extended ends, or both may mix the substance.

In an embodiment, a system for mixing includes a motor having a first longitudinal axis and an elongate member having a first end, a second end, and a second longitudinal axis. The elongate member further includes a first opening passing through the elongate member and a first filament disposed within the first opening, the first filament extending from at least one side of the first opening, wherein the elongate member is coupled to the motor such that the first and second longitudinal axes are collinear. In an embodiment, the system may include an elongate member, with one or more openings and one or more filaments, with the filaments and holes configured as described in any other embodiment.

DETAILED DESCRIPTION

An embodiment provides a mixer tool with a drill bit having a series of openings formed along the longitudinal axis. A filament, disposed in the openings and extending from the openings, sweeps through an arc when the bit is rotated about the longitudinal axis. Such movement of the filament may be used to quickly mix liquids when clamped in the chuck of a hand drill. For example, the several embodiments may be used for mixing paint. Also, the several embodiments may be used for purposes other than mixing, e.g., agitating, aerating, liquefying, or changing the viscosity of other (perhaps already-mixed) substances. This disclosure should not be construed to limit the uses for the claimed subject matter.

FIG. 1 is a top view of a mixer 100 according to an embodiment. In FIG. 1, mixer 100 includes an elongate member 105 and a filament 130. Elongate member 105 includes a chuck section 110, a shaft section 115, and a filament section 120. The longitudinal axes of chuck section 110, shaft section 115, and filament section 120 may be collinear to reduce vibration when mixer 100 is rotated.

Chuck section 110 is dimensioned to be received by the chuck of a drill. As such, chuck section 110 will typically be either cylindrical with a constant diameter (i.e., a chuck end 112 may be circular), or hexagonal with a constant long diagonal (i.e., chuck end 112 may be hexagonal). Chuck section 110 may have a demarcation notch 114 at the transition from chuck section 110 to shaft section 115. Shaft section 115 may be optional, or may have an arbitrary length chosen to create distance between chuck section 110 and filament section 120. The length may be chosen to allow a user to, e.g., immerse the filament section 120 to a depth greater than the length of filament section 120 without also having to immerse the chuck or hand drill, or to distance the chuck and attached hand drill from potential splattering.

Filament section 120 has a plurality of openings 124*a*, 124*b*, 124*c* . . . 124*l* formed within it. The embodiment depicts twelve openings, but in other embodiments the number of openings and the dimensions of filament section 120 may be decreased or increased to satisfy the need to mix liquids in shallower or deeper containers, or to accommodate relatively thicker or thinner filaments. In the embodiment, openings 124*a* . . . 124*l* are formed through and perpendicular to the longitudinal axis of filament section 120 and are parallel to each other. In other embodiments openings 124*a* . . . 124*l* may be offset from the longitudinal axis (i.e., not pass through the longitudinal axis) and may also not be parallel to each other.

In the embodiment of FIG. 1, filament 130 is disposed within each of openings 124*a* . . . 124*l*, with filament ends 132*a*, 132*b* extending from filament section 120. As disposed within openings 124*a*, . . . 124*l*, filament 130 creates bights (or "loops"), e.g., bights 134*a*, 134*b*, 134*c*, 134*d*, and 134*e*, between each pair of adjacent openings. In the embodiment, both filament ends 132*a*, 132*b* and bights 134*a*, et seq., extend away from filament section 120. Thus, when elongate member 105 is rotated about its longitudinal axis, filament ends 132*a*, 132*b* and bights 134*a*, et seq., sweep through an arc. Such action may be used to, e.g., mix a substance, such as paint.

In an embodiment, openings 124*a* . . . 124*l* may be circular holes or other non-circular openings. For example, openings 124*a* . . . 124*l* may be slots. In such case, the slot-shaped openings 124*a* . . . 124*l* may be dimensioned to allow filament 130 to be threaded through, yet slot-shaped openings 124*a* . . . 124*l* may also compress filament 130 and thereby work to retain or stabilize the position of filament 130.

In an embodiment, openings 124*a* . . . 124*l* may not be parallel. For example, in an embodiment neighboring openings, e.g., openings 124*a* and 124*b*, may be rotated about the longitudinal axis of elongate member 105 with respect to each other. Thus, opening 124*a*, when viewed from elongate member end 122 and using a clock face as reference, may run from 3 o'clock to 9 o'clock and opening 124*a* may run from 4 o'clock to 10 o'clock. Such rotation causes bights 134*a*, et seq., to be distributed around filament section 120 when viewed from elongate member end 122. A benefit of such distribution is that bights 134*a*, et seq., may fold down toward chuck end 112 without hitting as many other bights in the process. An embodiment with such distributed bights may be inserted through an opening with a smaller diameter than the embodiment of FIG. 1. So, for example, since smaller animals tend to have smaller openings in the skull for the spinal column, the embodiment with distributed bights could be used to liquefy and remove the brains from the skull cavities of a greater size-range of animals.

In an embodiment, bights may be created by threading filament 130 through holes 124*a* . . . 124*l* in a different order, e.g., by threading from opening 124*a* to opening 124*c*, then to opening 124*b*, etc.

Figure 2B:
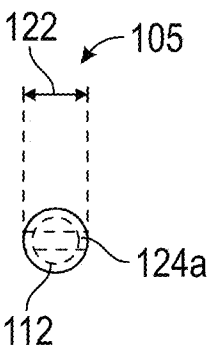
FIG. 2B is a front view of the element of a mixer of FIG. 2A.
Figure 2A:
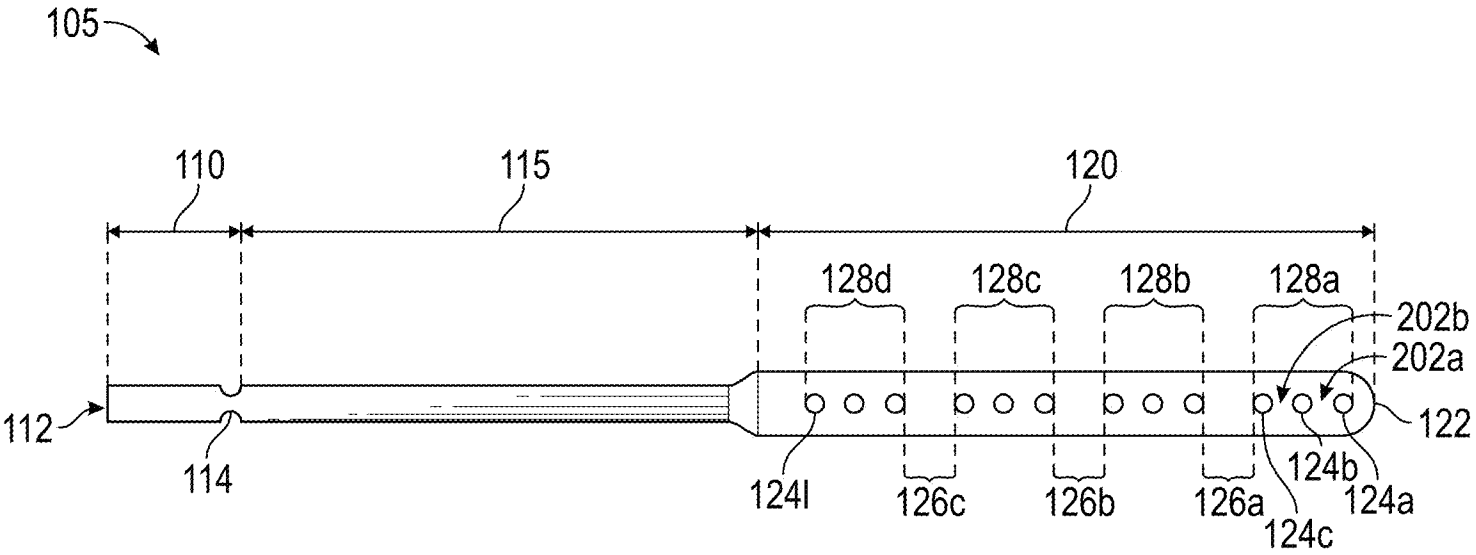
FIG. 2A is a right side view of an element of a mixer according to an embodiment.

FIG. 2A is a right side view of elongate member 105 of FIG. 1. FIG. 2*a* depicts openings 124*a* . . . 124*l* separated into opening groups 128*a*, 128*b*, 128*c*, and 128*d*, each group including three openings. Opening groups are separated by a group distance 126*a*, 126*b*, and 126*c*, where group distances 126*a*, 126*b*, and 126*c* are equal. Within each group the individual openings are separated by the same distance, e.g., opening distances 202*a* and 202*b*, where opening distances 202*a* and 202*b* are equal.

FIG. 2B is a front view of elongate member 105 of FIG. 2A. FIG. 2B illustrates that elongate member end 122 may have a greater diameter than chuck end 112. FIG. 2B further illustrates that openings 124*a* . . . 124*l* are parallel and through the longitudinal axis of elongate member 105.

Figure 3A:
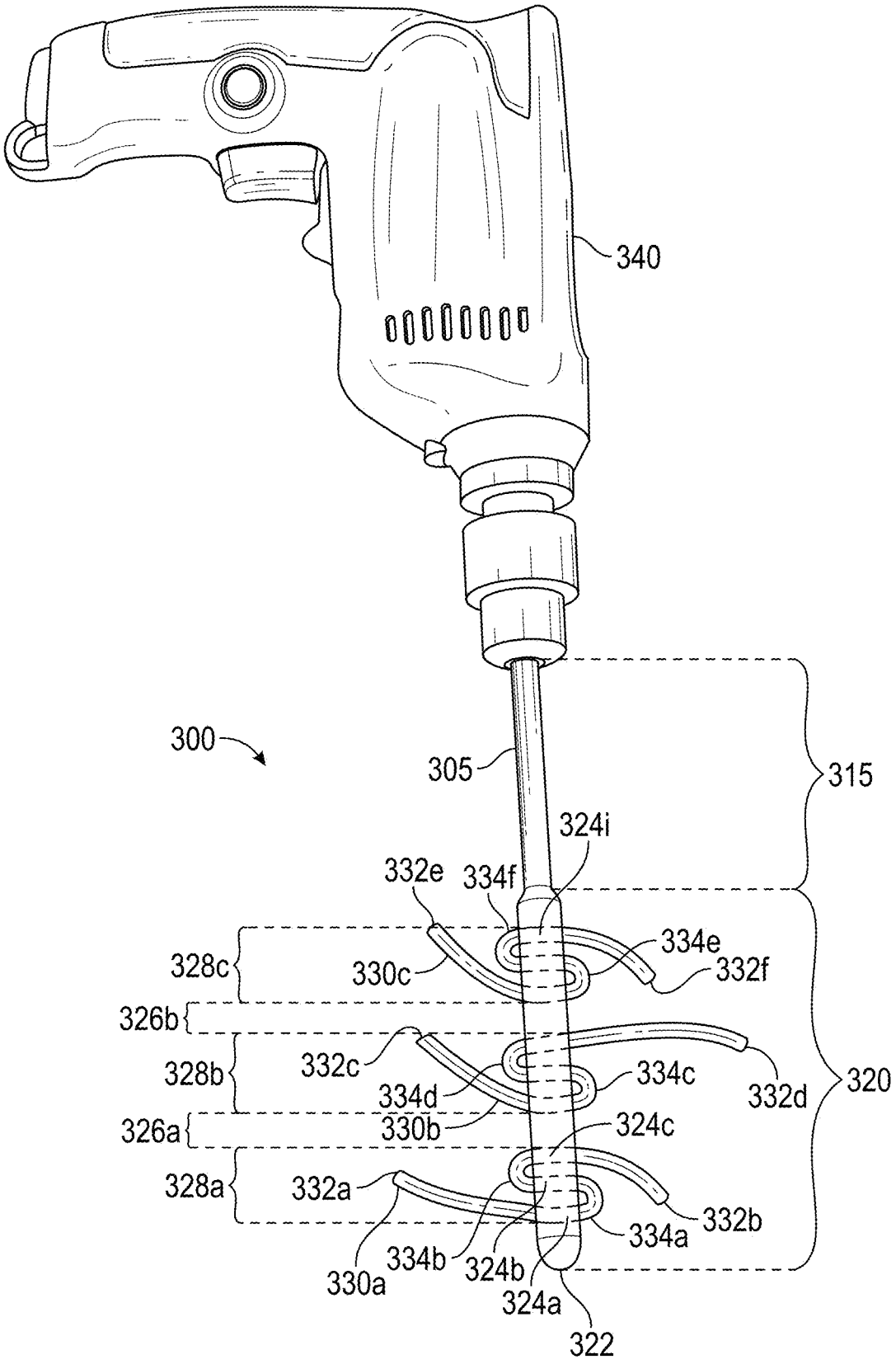
FIG. 3A is a top view of a mixer according to an embodiment.

FIG. 3A is a top view of a mixer 300 according to an embodiment. In FIG. 3A, an elongate member 305 is held in the chuck of a hand drill 340. Elongate member 305 includes filaments 330*a*, 330*b*, and 330*c*. Elongate member 305 includes a chuck section (FIG. 3B, element 322), a shaft section 315, and a filament section 320. The longitudinal axes of the chuck section (FIG. 3B, element 322), shaft section 315, and filament section 320 may be collinear to reduce vibration when elongate member 305 is rotated at speed by drill 340.

Shaft section 315 may be optional, or may have an arbitrary length chosen to create distance between chuck section (FIG. 3B, element 322) and filament section 320. The length may be chosen to allow a user to, e.g., immerse the filament section 320 to a depth greater than the length of filament section 320 without also having to immerse the chuck or hand drill, or to distance the chuck and attached hand drill from potential splattering.

Filament section 320 has a plurality of openings 324*a*, 324*b*, 324*c* . . . 324*i* formed within it. The embodiment depicts nine openings, but in other embodiments the number of openings and the dimensions of filament section 120 may be decreased or increased to satisfy the need to mix liquids in shallower or deeper containers, or to accommodate relatively thicker or thinner filaments. In the embodiment, openings 324*a* . . . 324*i* are formed through and perpendicular to the longitudinal axis of filament section 320 and are parallel to each other. In other embodiments openings 324*a* . . . 324*i* may be offset from the longitudinal axis (i.e., not pass through the longitudinal axis) and may also not be parallel to each other.

In the embodiment of FIG. 3A, filaments 330*a*, 330*b*, and 330*c* are disposed within opening groups 328*a*, 328*b*, and 328*c*, respectively. That is, filament 330*a* is threaded through openings 324*a*, 324*b*, and 324*c*; leaving filament ends 332*a*, 332*b* extended away from filament section 320. Filaments 330*b* and 330*c* are threaded similarly. As disposed within openings 324*a* . . . 324*i*, filaments 330*a*, 330*b*, 330*c* still create bights (or "loops"), e.g., bights 334*a* . . . 334*f*, between each pair of adjacent openings. However, in the embodiment, bights 334*a* . . . 334*f* are against or close to filament section 320 so that, relatively, filament ends 332*a* . . . 332*f* extend away from filament section 320. Thus, when elongate member 305 is rotated about its longitudinal axis, filament ends 332*a* . . . 332*f* sweep through an arc. Such action may be used to, mix a substance, e.g., paint. In an embodiment, bights 334*a* . . . 334*f* are enlarged so that they extend further away from filament section 320. In this manner, by changing the distance that one or more of filaments ends 332*a* . . . 332*f* and bights 334*a* . . . 334*f* extend away from filament section 320, the volume swept through by the sum of filaments 330*a*, 330*b*, and 330*c* during one rotation of elongate member 305 may be changed. Thus the embodiment provides a way to increase or decrease the mixing effect of the embodiment that is independent from drill speed or filament thickness.

In an embodiment, openings 324*a* . . . 324*i* may be circular holes or other non-circular openings. For example, openings 324*a* . . . 324*i* may be slots. In such case, the slot-shaped openings 324*a* . . . 324*i* may be dimensioned to allow filaments 330*a*, 330*b*, and 330*c* to be threaded through, while slot-shaped openings 324*a* . . . 324*i* may also partially compress filaments 330*a*, 330*b*, 330*c* and thereby work to retain or stabilize the position of filaments 330*a*, 330*b*, and 330*c*.

In an embodiment, openings 324*a* . . . 324*i* may not be parallel. For example, in an embodiment neighboring openings, e.g., openings 324*a* and 324*b*, may be rotated about the longitudinal axis of elongate member 305 with respect to each other. Thus, opening 324*a*, when viewed from elongate member end 322 and using a clock face as reference, may run from 3 o'clock to 9 o'clock and opening 324*b* may run from 4 o'clock to 10 o'clock. Such rotation causes bights 334*a*, et seq., to be distributed around filament section 320 when viewed from elongate member end 322. A benefit of such distribution is that filament ends 332*a* . . . 332*f* may fold down toward drill 340 without hitting as many other filament ends in the process. An embodiment with such distributed bights may be inserted through an opening with a smaller diameter than the embodiment of FIG. 3A.

Figure 3B:
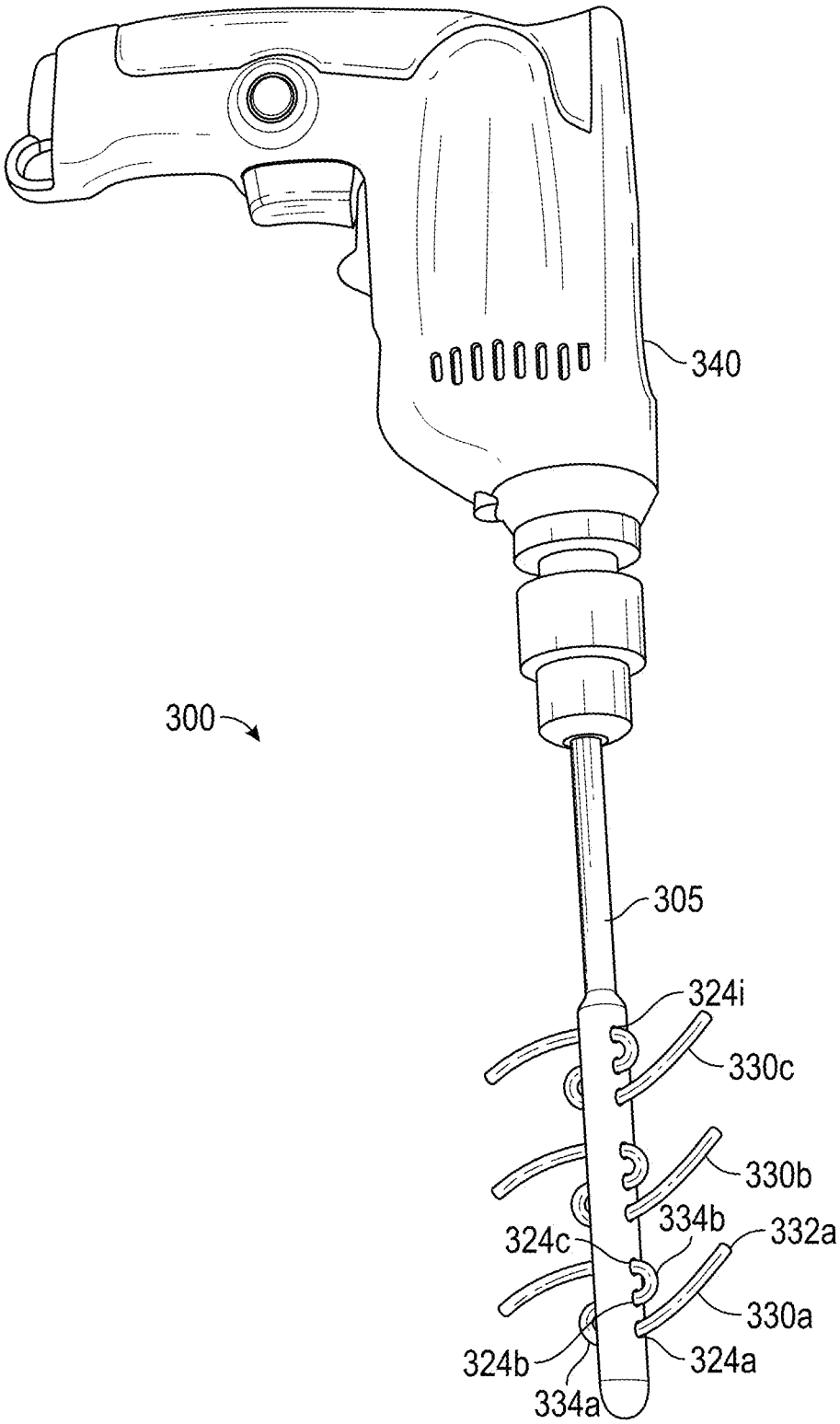
FIG. 3B is a perspective view of the mixer of FIG. 3A.

FIG. 3B is a perspective view of the mixer of FIG. 3A. In FIG. 3B, it can be seen that bights 334*a* . . . 334*n* may extend some distance from elongate member 305. However, because bights 334*a* . . . 334*n* do not extend nearly as far as filament ends 332*a* . . . 332*f* the majority of the volume swept by the embodiment is due to filament ends 332*a*, . . . 332*f*.

Figure 4B:
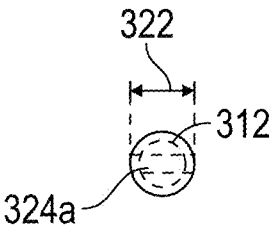
FIG. 4B is a front view of the element of a mixer of FIG. 4A.
Figure 4A:
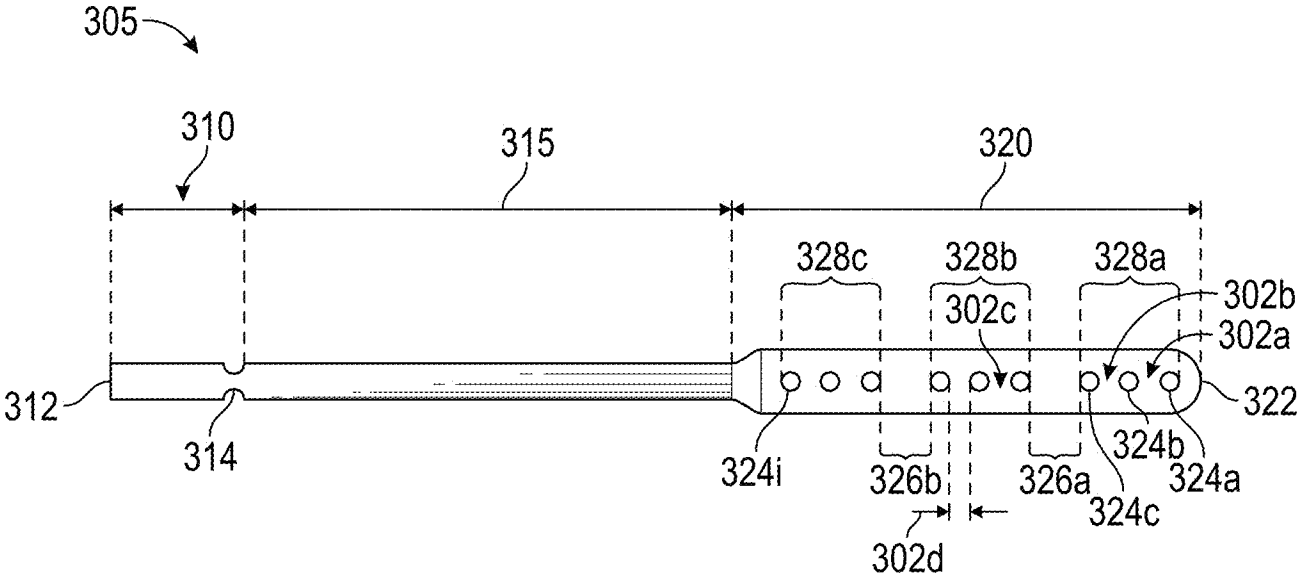
FIG. 4A is a right side view of an element of a mixer according to an embodiment.

FIG. 4A is a right side view of elongate member 305 of FIG. 3A. FIG. 4A depicts openings 324*a*, . . . 324*i* separated into opening groups 328*a* and 328*b*, and 328*c*, each group including three openings. Opening groups are separated by a group distance 326*a* and 326*b*, where group distances 326*a* and 326*b* are equal. Within each group the individual openings are separated by the same distance, e.g., opening distances 302*a* and 302*b*, where opening distances 302*a* and 302*b* are equal.

FIG. 4B is a front view of elongate member 305 of FIG. 4A. FIG. 4B illustrates that elongate member end 322 has a greater diameter than chuck end 312. FIG. 4B further illustrates that openings 324*a* . . . 324*i* are parallel and through the longitudinal axis of elongate member 305.

Figure 5A:
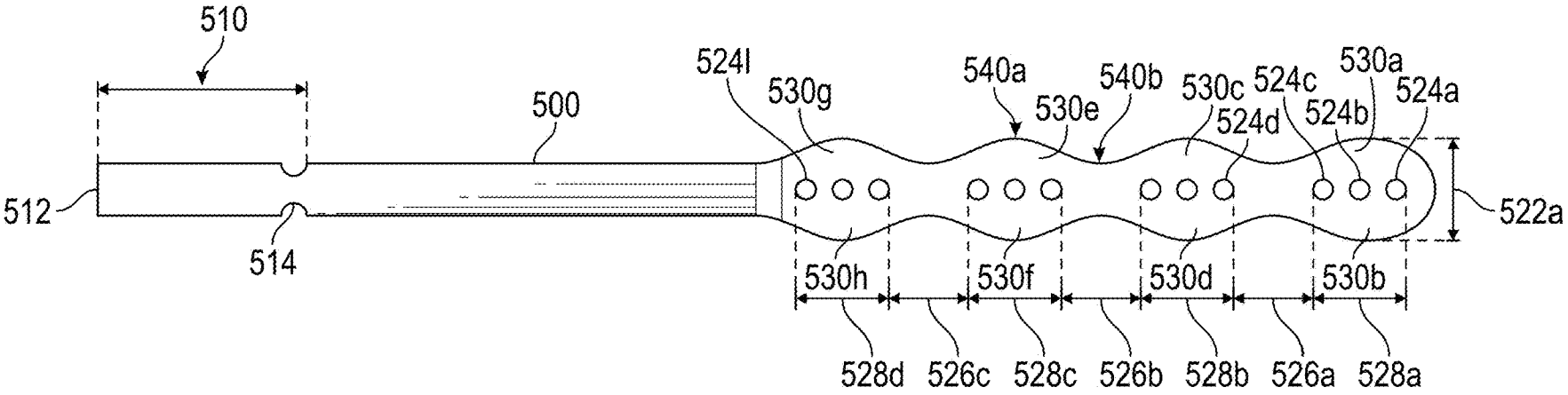
FIG. 5A is right side view of an element of a mixer according to an embodiment.
Figure 5B:
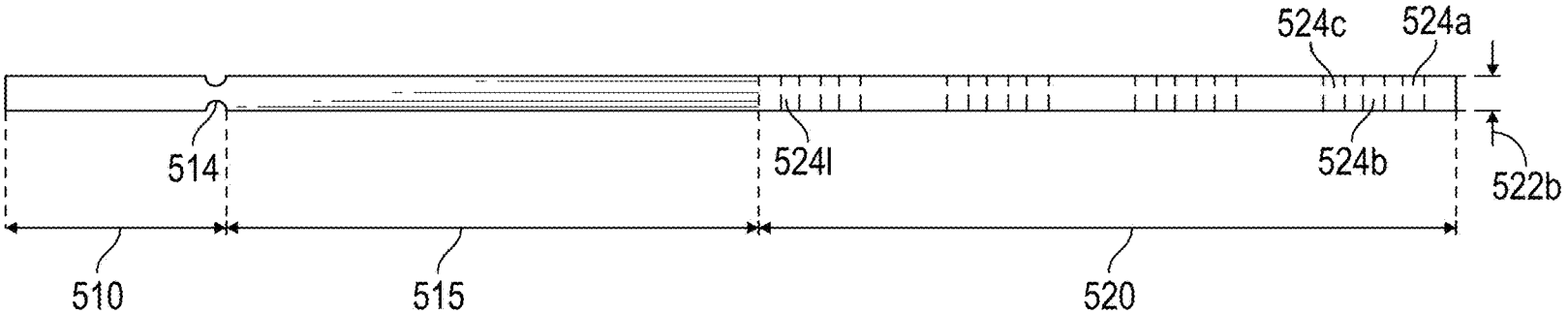
FIG. 5B is a front view of the element of a mixer of FIG. 5A.

FIGS. 5A and 5B depict an embodiment of an elongate member 500. FIG. 5A is right side view of elongate member 500. FIG. 5B is a top view of elongate member 500. In FIG. 5A, elongate member 500 includes a chuck section 510, a shaft section 515, and a filament section 520. Chuck section 510 and shaft section 515 may be similar to the chuck sections and shaft sections described previously with reference to FIGS. 1-4B. Filament section 520 has a plurality of openings 524*a*, 524*b*, 524*c* . . . 524*n* formed within it. The embodiment depicts twelve openings, but in other embodiments the number may be decreased or increased to satisfy the need to mix liquids in shallower or deeper containers, or to accommodate relatively thicker or thinner filaments. In the embodiment, openings 524*a* . . . 524*n* are formed through and perpendicular to the axis of symmetry of filament section 120 and are parallel to each other. In other embodiments openings 524*a* . . . 524*n* may be offset from the axis of symmetry (i.e., not pass through the axis of symmetry) and may also not be parallel to each other.

In FIG. 5A, openings 524*a* . . . 524*n* separated into opening groups 528*a*, 528*b*, 528*c*, and 528*d*, each group including three openings. Opening groups are separated by a group distance 526*a*, 526*b*, and 526*c*, where group distances 526*a*, 526*b*, and 526*c* are equal. Within each group the individual openings are separated by the same distance, as discussed above.

In an embodiment, the distances between individual openings and between any groups of openings may be varied arbitrarily.

In the embodiment of FIGS. 5A and 5B, filament section 520 has flat right and left sides with a maximum width 522*a* and a thickness 522*b*. Thickness 522*b* is equal to diameter 512 of chuck section 510 and shaft section 515. Maximum width 522*a* is created by the addition of lobes 530*a*, 530*b*, 530*c* . . . 530*h* to either side of openings 524*a* . . . 524*n*. For example, lobes 530*a* and 530*b* are on opposite sides of opening group 528*a*. Lobes 530*a* . . . 530*h* extend away from the axis of symmetry of filament section 520, in so doing lobes 530*a* . . . 530*h* increase the volume swept by the rotation of filament section 520. In this manner, lobes 530*a* . . . 530*h* increase the mixing action contribution of elongate member 500 itself. The longitudinal axes of chuck section 510 and shaft section 515, and the axis of symmetry of filament section 520 may be collinear to reduce vibration when elongate member 500 is rotated. FIG. 5B further illustrates that openings 524*a* . . . 524*n* are parallel.

In an embodiment, each lobe may be defined by an outer radius 540*a* and an inner radius 540*b*.

In an embodiment, a filament or filaments may be disposed in openings 524*a* . . . 524*n* of FIGS. 5A and 5B as described previously with reference to FIGS. 1-4B. Similarly, in embodiments, openings 524*a* . . . 524*n* may be other than circular, may be other than parallel, and may be rotated about the axis of symmetry, all as described with reference to FIGS. 1-4B.

In an embodiment the filament material may include: string, wire, monofilament fishing line, co-filament line, braided line, thermally fused line, fluorocarbon line, weed trimmer line, and cable ties, all of various thicknesses and strengths. Examples of the material of the line that may be used including nylon, polyvinylidene fluoride (PVDF, also called fluorocarbon), polyethylene, Dacron® and Dyneema® (UHMWPE). The length, material, and weight of the line may be determined based upon the application. Factors that may determine what line is chosen for a given application include: breaking strength, limpness, stretch, abrasion resistance, and durability. Braided, co-filament, and thermally fused lines are also known as "superlines" for their small diameter, lack of stretch, and great strength relative to standard nylon monofilament lines. Braided, thermally fused, and chemically fused varieties of "superlines" are now readily available. The mixer tool may be used with both single- and multi-strands threaded through the openings. Softer line may be used, such as string or yarn for uses that require more flexibility in order to fit within a smaller space or to prevent breakage of the workpiece.

An aspect of various embodiments is that the filament may be replaced for a number of reasons, e.g., if worn, fatigued, broken, or not suitable for use with a particular substance. Thus, various embodiments may be repaired economically and may also be adapted to different substances.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A hand drill accessory apparatus for mixing, comprising:

an elongate member having a first end, a second end, a longitudinal axis, a first section extending from the first end, and a second section extending from the first section to the second end, such that the first section and the second section comprise an entire length of the elongate member, the first section having a first cross-sectional area perpendicular to the longitudinal axis that is uniform along a majority of the length of the first section, and the second section having a second cross-sectional area perpendicular to the longitudinal axis that is uniform along a majority of the length of the second section, wherein the second cross-sectional area is greater than the first cross-sectional area; and at least one opening formed through the second section of the elongate member, each of the at least one opening having a lengthwise axis that is parallel to the second cross-sectional area;

wherein the at least one opening is configured to receive at least a portion of a filament therein, such that the filament may extend from at least one side of the at least one opening.

2. The apparatus of claim 1, wherein the at least one opening comprises at least three openings, each opening of the at least three openings being offset from an adjacent opening by being rotated about the longitudinal axis relative to the adjacent opening.

3. A hand drill accessory apparatus for mixing, comprising:

an elongate member having a first end, a second end, and a longitudinal axis, the first end being configured for insertion in a chuck of a drill, the second end having a synclasctic tip, the elongate member being symmetrical about two perpendicular planes whose intersection is coincident with the longitudinal axis; and a first plurality of openings, each opening of the first plurality of openings extending through the elongate member;

wherein each of the first plurality of openings is configured to receive at least a portion of a filament therein.

4. The apparatus of claim 3 wherein each of the first plurality of openings passes from a first side of the elongate member through to a second side of the elongate member, the apparatus further including:

a second plurality of openings, each opening of the second plurality passing from the first side of the elongate member through to the second side of the elongate member.

5. The apparatus of claim 1, wherein the second cross-sectional area is a circle.

6. The apparatus of claim 4, wherein the first plurality of openings comprises a first opening, a second opening, a third opening, and the second plurality of openings comprises a fourth opening, a fifth opening, and a sixth opening, wherein distances between the first and second openings, the second and third openings, the fourth and fifth openings, and the fifth and sixth openings are approximately equal, and wherein a distance between the third and fourth openings is greater than the distances between the first and second openings, the second and third openings, the fourth and fifth openings, and the fifth and sixth openings.

7. The apparatus of claim 6, further comprising:

a single filament extending through each of the first, second, third, fourth, fifth, and sixth openings.

8. The apparatus of claim 3, wherein a cross-sectional area of the elongate member perpendicular to the longitudinal axis proximate the second end is greater than a cross-sectional area of the elongate member perpendicular to the longitudinal axis proximate the first end.

9. A hand drill accessory apparatus for mixing, comprising:

an elongate member having a first end, a second end, a longitudinal axis, a first section extending from the first end, and a second section extending from the first section to the second end, at least a portion of the first section having a hexagonal cross section perpendicular to the longitudinal axis, at least a portion of the second section having a circular cross section perpendicular to the longitudinal axis, the second section including a plurality of openings extending therethrough;

wherein each of the plurality of openings is configured to receive at least a portion of a filament therein.

10. The apparatus of claim 9, wherein the second section includes a synclastic tip.

11. The apparatus of claim 10, wherein one of the plurality of openings intersects the synclastic tip.

12. The apparatus of claim 9, wherein the plurality of openings comprises a first opening, a second opening, a third opening, a fourth opening, a fifth opening, and a sixth opening, wherein distances between the first and second openings, the second and third openings, the fourth and fifth openings, and the fifth and sixth openings are approximately equal, and wherein a distance between the third and fourth openings is greater than the distances between the first and second openings, the second and third openings, the fourth and fifth openings, and the fifth and sixth openings.

13. The apparatus of claim 12, wherein the plurality of openings further comprises a seventh opening, an eighth opening, a ninth opening, a tenth opening, a eleventh opening, and a twelfth opening, wherein distances between the seventh and eighth openings, the eighth and ninth openings, the tenth and eleventh openings, and the eleventh and twelfth openings are approximately equal to the distances between the first and second openings, the second and third openings, the fourth and fifth openings, and the fifth and sixth openings, and wherein distances between the sixth and seventh openings and the ninth and tenth openings are approximately equal to the distance between the third and fourth openings.

14. The apparatus of claim 13, further comprising:

a first filament extending through each of the first, second, and third openings; and a second filament extending through each of the fourth, fifth, and sixth openings.

15. The apparatus of claim 14, further comprising:

a third filament extending through each of the seventh, eighth, and ninth openings; and a fourth filament extending through each of the tenth, eleventh, and twelfth openings.

16. The apparatus of claim 9, further comprising:

a single filament extending through each of the plurality of openings.

17. The apparatus of claim 9, wherein a width of the circular cross section of the second section is greater than a width of the hexagonal cross section of the first section.

18. The apparatus of claim 9, wherein the first section includes a demarcation notch.

* * * * *